US005509642A

United States Patent [19]

Wells

[11] Patent Number: 5,509,642

[45] Date of Patent: Apr. 23, 1996

[54] MATTRESS INNERSPRING STRUCTURE HAVING COAXIAL COIL UNITS

[75] Inventor: Thomas J. Wells, Carthage, Mo.

[73] Assignee: L&P Property Management Company, Chicago, Ill.

[21] Appl. No.: 406,694

[22] Filed: Mar. 20, 1995

[51] Int. Cl.[6] ..... F16F 3/00

[52] U.S. Cl. ..... 267/92; 5/248; 5/256

[58] Field of Search ..... 5/248, 253, 256, 5/269; 267/91–93, 97, 101

[56] References Cited

U.S. PATENT DOCUMENTS

| | | | |
|---|---|---|---|
| 882,654 | 3/1908 | Smith | 5/253 |
| 1,254,314 | 1/1918 | D'arcy | 5/256 |
| 1,544,237 | 6/1925 | Karr | 5/256 |
| 1,925,868 | 9/1933 | Ehlenbeck et al. | 5/246 |
| 2,265,426 | 12/1941 | Foster | 5/269 |
| 2,781,083 | 2/1957 | Agrillo et al. | 155/179 |
| 3,069,701 | 12/1962 | McInerney | 5/351 |
| 4,034,429 | 7/1977 | Smith | 5/256 |
| 4,051,567 | 10/1977 | Hutchinson | 5/248 |
| 4,726,572 | 2/1988 | Flesher et al. | 5/256 X |
| 4,781,360 | 11/1988 | Ramsey | 5/248 X |
| 4,867,423 | 9/1989 | Marsh | 267/91 |
| 4,960,267 | 10/1990 | Scott | 267/91 |

FOREIGN PATENT DOCUMENTS

| | | | |
|---|---|---|---|
| 756477 | 4/1967 | Canada | 5/248 |
| 20583 | 9/1910 | United Kingdom | 5/256 |
| 218194 | 12/1923 | United Kingdom | 267/91 |

*Primary Examiner*—Robert J. Oberleitner
*Assistant Examiner*—Chris Schwartz
*Attorney, Agent, or Firm*—Wood, Herron & Evans

[57] ABSTRACT

An innerspring structure for a mattress comprises a plurality of outer coils extending generally parallel with each other to collectively form top and bottom face surfaces of the innerspring structure. One or more of the outer coils has an inner coil of preferably similar shape wound within and generally coaxially with the respective outer coil. Helical lacing wire wraps adjacent end turns of the inner and outer coaxially aligned coils together to form reinforced coil units in an area of the innerspring structure to increase the firmness of an area of the mattress utilizing the invention. Helical lacing wire connects the coils of the structure together and connects the end turns of peripheral coils to a border wire surrounding the periphery of the structures at the top and bottom face surfaces.

15 Claims, 2 Drawing Sheets

MATTRESS INNERSPRING STRUCTURE HAVING COAXIAL COIL UNITS

FIELD OF THE INVENTION

This invention relates generally to mattress innerspring structures and specifically to an innerspring structure having sections of enhanced firmness.

BACKGROUND OF THE INVENTION

Conventionally, mattress innerspring structures comprise a plurality of coil springs which are positioned adjacent one another to extend between top and bottom face surfaces of a mattress. The individual coil springs or coils are held together by various means to form a unitary innerspring structure.

The coils in the innerspring structure are typically formed very similar to each other, having generally the same coil diameter and stiffness. Therefore, the top surface of a typical mattress will have generally equal firmness throughout the mattress. However, it is often desirable to make certain areas on the mattress more firm than other areas of the mattress. For example, it may be desirable to firm up the center section of the mattress which receives a majority of the weight from a person lying thereon. Further, it may be desirable to make the edge of a mattress more firm or durable to withstand pressures created when people sit on the end of their bed.

Therefore, it is an objective of the present invention to increase the firmness in selected areas of a mattress.

It is a further objective to increase the durability of selected areas on a mattress which receive a high amount of loading during normal usage.

Accordingly, it is another objective of the invention to provide an innerspring structure which is more firm and provides greater support in certain areas thereon than in other areas.

Furthermore, it is an objective of the invention to provide such an innerspring structure at a relatively low cost and with a relatively uncomplicated design.

SUMMARY OF THE INVENTION

In accordance with the above-stated objectives, an innerspring structure utilizes reinforced coil units having a coil within a coil design constructed and coupled together by helical lacing wire. The innerspring structure comprises a plurality of side-by-side coils, referred to as outer coils, which extend generally parallel to one another and are arranged in aligned rows. The outer coils have opposing end turns which collectively form top and bottom face surfaces of the innerspring structure. Selected rows or selected areas of the innerspring structure include one or more inner coils which extend between the top and bottom face surfaces of the structure. The inner coils are each wound generally coaxially within a respective outer coil, such that the end turns of the inner and outer coils are adjacent each other. A matrix of helical lacing wires connects the inner and outer coils together at the end turns to form a reinforced coil unit, having a coil within a coil. The reinforced coil units have enhanced firmness or stiffness relative the unitary outer coils.

The lacing matrix also connects the aligned rows of coils together. The lacing matrix includes a plurality of spaced apart helical wires which extend generally parallel one another and perpendicular to the aligned rows. Each wire wraps together the end turns of adjacent coils such that each coil within a row is connected to an adjacent coil in that row. The reinforced coil units and unitary outer coils are connected together to form a unitary innerspring structure. Another helical wire is wound around the periphery of the innerspring structure to connect peripheral coils to a thick border wire for enhanced edge firmness in the innerspring structure. The rows or areas of the innerspring structure, which include the units of inner coils within outer coils, create an area having a stiffness or firmness which is higher than those areas which only utilize unitary outer coils.

In a preferred embodiment of the invention, each coil unit within a selected row or rows of coils utilizes an inner coil within an outer coil, such that reinforced rows of coils are produced. The respective inner and outer coils of a reinforced coil unit preferably have the same pitch and the same winding direction, i.e., left hand or right hand winding, Furthermore, the coils are formed such that the end turns and intermediate turns of each of the inner and outer coils have the same diameter. As such, the inner and outer coils preferably have a similar shape and nest together to form a coil unit with a double wire thickness to provide the desired firmness in selected areas of the mattress.

Therefore, the innerspring structure of the present invention provides the desired increased firmness and durability for selected areas of the mattress utilizing coils within coils laced by helical lacing wire. The inner and outer coils utilized to form the reinforced coil unit are preferably similar and therefore, the complexity of manufacturing the innerspring structure is not drastically increased over the process used to make a conventional innerspring structure with the same firmness throughout. Furthermore, no special wire or coiling techniques are necessary for creating the reinforced coil units, thereby keeping manufacturing costs to a minimum.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
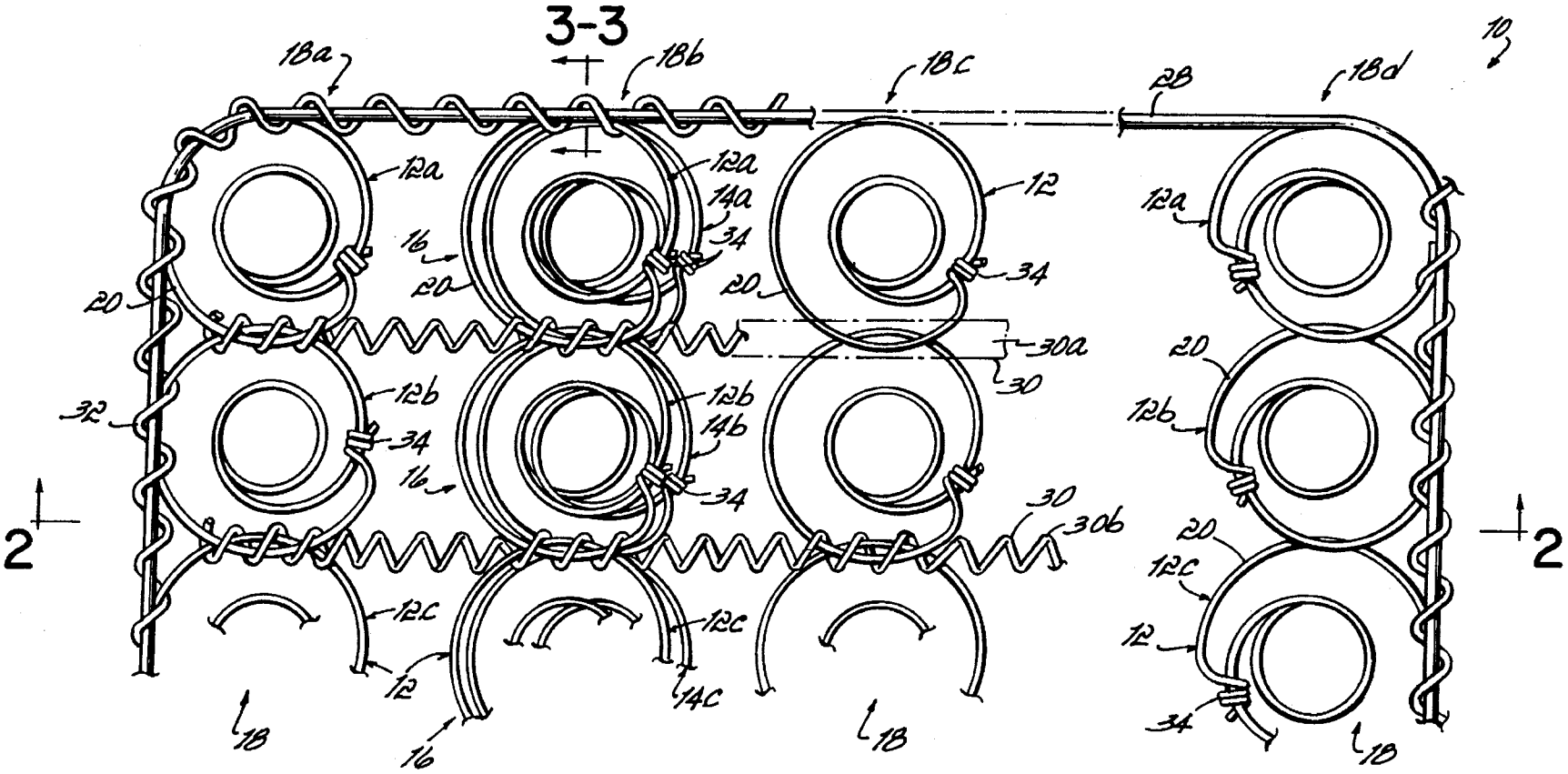
FIG. 1 is a top view of the innerspring structure of the present invention utilizing reinforced coil units laced together by a helical wire matrix.

FIG. 1 illustrates the innerspring structure 10, which utilizes the reinforced coil units of the present invention. Innerspring structure 10 includes a plurality of coils 12, which are referred to as outer coils for the purpose of this invention. Some of the outer coils 12 are utilized in conjunction with other coils 14, referred to as inner coils, which are placed within certain of the outer coils 12 to form reinforced coil units 16 as described further hereinbelow.

Although, the inner coils 14 and respective outer coils 12 are preferably coaxial, each coil and its turns may vary in orientation with respect to the other. Therefore, the terms "inner" and "outer" are used primarily for reference and do not necessarily indicate the overall coil orientations within the reinforced coil unit 16.

To form the body of innerspring structure 10, the outer coils 12 are arranged side-by-side with each other and are placed in aligned rows 18. The outer coils 12 consist of a series of wire turns and each coil has opposing end turns 20, 22 (see FIG. 2). The respective end turns 20, 22 of the coils 12 collectively lie in generally the same opposing planes and define a top face surface 24 and an opposing bottom face surface 26, of the innerspring structure 10. A reinforced border wire 28, which preferably has a diameter greater than the diameter of the wires used to wind the coils 12, 14, is placed around the periphery of the innerspring structure 10 at the top face surface 24 and the bottom face surface 26. The border wire 28 provides enhanced strength at the innerspring edges.

Figure 2:
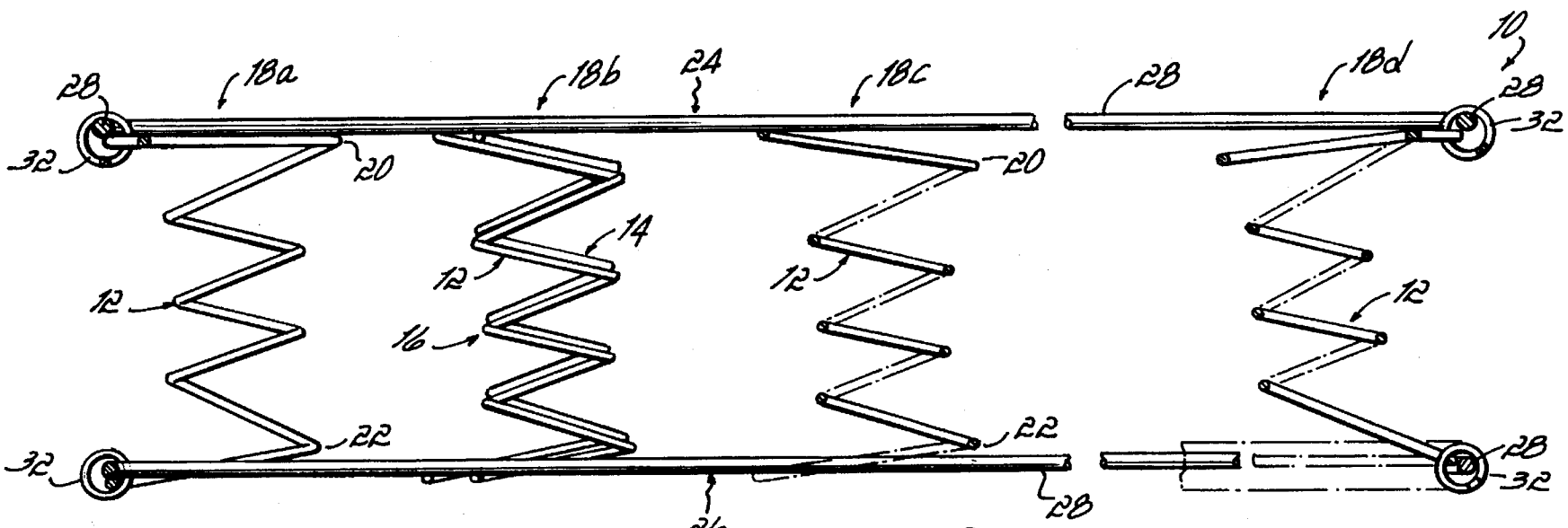
FIG. 2 is cross-sectional view taken on lines 2—2 of the innerspring structure of FIG. 1.

In accordance with the principles of the present invention, certain areas of the innerspring structure 10, and specifically, certain coil rows of the innerspring structure, such as row 18*b*, are made more firm than other coil rows, such as rows 18*c* and 18*d*, by utilizing reinforced coil units 16 formed by placing an inner coil 14 within each outer coil 12 of the row. Each inner coil 14 is wound generally similarly to its respective outer coil 14. For example, inner coil 14a is wound in the same direction as outer coil 12*a*, (the right hand direction from the top face surface 24 to bottom face surface 26 in FIGS. 1 and 2). Further, inner coil 14*a* has generally the same pitch (turns per unit length) as outer coil 12*a*. Each inner coil 14 is placed within an outer coil 12, and as illustrated in FIG. 2, the coil within a coil structure forms a reinforced coil unit 16, which has a double wire thickness. The outer and inner coils 12, 14 are effectively nested together and extend generally coaxially one with the other such that coil turns of each coil remain generally adjacent each other in the mattress and are flexed simultaneously when a load is applied to face surfaces 24, 26 (see FIG. 2). As discussed above, the corresponding orientations of adjacent turns of the coils change with respect to each other such that one coil turn is inside of or outside of the other turn regardless of whether the coil is designated as an "inner" or "outer" coil.

The coils 12, 14 of innerspring structure 10 are held or laced together by a matrix of helical wires, More specifically, referring to FIG. 1, a plurality of spaced-apart helical wires 30 extend longitudinally in the innerspring structure 10 generally perpendicular to the aligned coil rows 18. The helical lacing wires 30 connect the adjacent coils within a row. For example, and as illustrated in FIG. 1, one helical lacing wire 30*a* would connect the first and second coils 12*a*, 12*b* within the rows, such as rows 18*a*, 18*b* and 18*c* while another helical lacing wire 30*b* would connect all of the second and third coils, 12*b*, 12*c*, respectively, in the rows 18*a*, 18*b*, 18*c*, etc. The helical wires 30 wrap the respective end turns of the adjacent coils 12, 14 proximate the face surfaces 24,26.

In addition to connecting the coils of a row together, the helical lacing wires 30 also connect the end turns of each inner coil 14 with the end turns of the respective outer coil 12, as illustrated in FIG. 1. Therefore, the helical lacing wires 30 form the reinforced coil units 16. As may be seen in row 18*b*, the top face surface end turns 20 of outer and inner coils 12*a*, 14*a* are connected together by lacing wire 30*a*. Further, the top end turns 20 of coils 12*a* and 14*a* are connected with the top face surface end turns 20 of outer and inner coils 12*b* and 14*b* by lacing wire 30*a*. Each helical wire 30 also extends generally from end to end in the innerspring structure 10 and spans between each aligned row 18 of coils and connects the rows of coils to the adjacent rows as illustrated in FIG. 1. In that way, innerspring structure 10 comprises a plurality of coils 12, 14, including reinforced units 16, which are connected together in rows by helical lacing wires 30. The lacing wires then connect together aligned rows 18 to form a unitary spring network for the innerspring structure 10.

Figure 3:
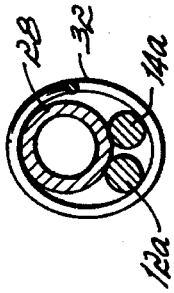
FIG. 3 is a cross-sectional view along lines 3—3 of FIG. 1 illustrating a reinforced coil unit of the invention helically laced to a border wire.

A helical wire 32 also extends around the periphery of the innerspring structure 10 with border wire 28. Helical wire 32 is wrapped to connect the border wire 28 with the top end turns 20 of each peripheral coil which is adjacent the border wire. In that way, the border wire 28 is secured into the unitary innerspring structure 10 to provide edge support for the structure. Helical wire 32 also connects the reinforced peripheral coil units 16 to border wire 28 at the ends of row 18*b*. As illustrated in FIG. 3, the border wire 28 is securely wrapped with the end turns of outer and inner coils 12*a*, 14*a* by the windings of the helical wire 32. In accordance with the principals of the present invention, row 18*b* comprises a plurality of reinforced coil units 16 such that a mattress utilizing the innerspring structure 10 will have increased firmness or stiffness proximate row 18*b*. Similarly, other rows of coils or individual coils might be formed as reinforced coil units 16, including outer and inner coils 12, 14 to selectively vary the firmness of a mattress in different areas. While only the top face surface 24 of the structure 10 is illustrated in FIG. 1, the bottom face surface 26 is similarly constructed and connected together utilizing a matrix of helical wires 30 between adjacent coils and the aligned rows and utilizing a second helical wire 32, which extends around a border wire 28. The helical wire 32, along the bottom face surface 26, is shown schematically by dashed lines in FIG. 2.

As illustrated in FIG. 1, the coil end turns 20 proximate upper face surface 24 terminate by wrap sections 34, which wrap around a portion of a coil turn to form a generally continuous coil. Similar wrap sections are used proximate the bottom face surface 26. The reinforced coil units 16 of the invention which are constructed and connected by a matrix of helical lacing wires 30 provide an innerspring structure 10 with areas of reinforced firmness. The reinforced coil units 16 are preferably formed utilizing coils 12, 14 with wires having similar diameters to the wires for the remaining outer coils 12 within the innerspring structure 10. Therefore, thicker wire is not utilized to increase the firmness in areas of structure 10 resulting in material cost savings. Furthermore, the innerspring structure 10 with firm areas having reinforced coil units 16 may be constructed generally similarly to a structure which does not utilize reinforced units, thus maintaining an efficient construction process. While only one row 18 is illustrated in the figures as including reinforced coil units 16, other coil rows might utilize similar reinforced coil units.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An innerspring structure for a mattress comprising:

a plurality of adjacent outer coils extending generally parallel to one another and arranged in aligned rows, each outer coil having opposing end turns resting in top and bottom face surfaces of the innerspring structure;

at least one inner coil extending between said top and bottom face surfaces and wound generally coaxially within one of said outer coils such that corresponding end turns of the inner and outer coils are adjacent one with the other at the top and bottom face surfaces; and a helical lacing wire wrapping together the adjacent end turns of the inner and outer coaxial coils and an end turn of an adjacent outer coil and connecting the coaxial inner and outer coils with the adjacent outer coil at a face surface of the spring interior for creating a reinforced coil unit at a position in the innerspring structure, said reinforced coil unit having generally equal strength along its length to provide generally equal support to the top and bottom face surfaces of the innerspring structure when placed therein.

2. The innerspring structure of claim 1 further comprising a plurality of inner coils, each inner coil generally coaxially wound within a respective outer coil and connected to the respective outer coil with said helical lacing wire for producing an area of reinforced coil units in the mattress interior.

3. The innerspring structure of claim 2 wherein the plurality of reinforced coil units are arranged in a row.

4. The innerspring structure of claim 1 wherein coil turns intermediate to the end turns of the inner coil have approximately the same diameter as corresponding coils turns intermediate to the end turns of the respective outer coil.

5. The innerspring structure of claim 4 wherein the helical wire spans across at least two aligned rows to operably connect the aligned rows together.

6. The innerspring structure of claim 4 further comprising a plurality of spaced apart helical wires which extend generally perpendicular to the aligned rows and wrap together the end turns of adjacent coils such that each coil within a row is connected to an adjacent coil in that row.

7. The innerspring structure of claim 1 wherein the helical wire extends generally perpendicular to the aligned rows and wraps together the end turns of adjacent coils within a row at one of said face surfaces of the innerspring structure.

8. The innerspring structure of claim 1 further comprising a border wire extending around the periphery of the aligned coil rows at one of said face surfaces of the innerspring structure and a second helical wife wrapped around a border wire and around end turns of peripheral coils adjacent to the border wire for forming a reinforced periphery at said face surface, said second helical wire being wrapped around said coaxial inner and outer coils of the reinforced coil unit to secure the unit to the border wire.

9. The innerspring structure of claim 1 wherein the inner and outer coils have approximately the same pitch.

10. A spring structure for use in an innerspring structure of a mattress comprising:

an outer coil having opposing end turns, the end turns configured for resting in top and bottom face surfaces of the innerspring structure;

an inner coil having a length for extending between said top and bottom face surfaces and wound generally coaxially within one of said outer coils such that corresponding end turns of the inner and outer coils are adjacent one with the other and are configured for placement at the top and bottom face surfaces; and a helical lacing wire wrapping together the adjacent end turns of the inner and outer coaxial coils for connecting the coaxial inner and outer coils together such that the coils are operable to move simultaneously in the innerspring structure and create a reinforced coil unit at a position in the innerspring structure, said reinforced coil unit having generally equal strength along its length to provide generally equal support to the top and bottom face surfaces of the innerspring structure when placed therein.

11. The spring structure of claim 10 wherein the inner and outer coils have approximately the same pitch.

12. The spring structure of claim 10 wherein coil turns intermediate to the end turns of the inner coil have approximately the same diameter as coil turns intermediate to the end turns of the respective outer coil.

13. A method of forming an innerspring structure for a mattress comprising:

placing a plurality of outer coils adjacent one another and generally parallel to each other such that opposing end turns of the coils collectively form top and bottom face surfaces of the innerspring structure;

positioning at least one inner coil within one of said outer coils such that the inner coil is wound generally coaxially with the outer coil and the respective end turns of the inner and outer coils are adjacent one with the other at the top and bottom face surfaces; and wrapping a helical lacing wire around the end turns of the inner and outer coaxial coils and an end turn of an adjacent outer coil and connecting the coaxial inner and outer coils with the adjacent outer coil at a face surface of the innerspring structure for creating a reinforced coil unit at a position in the innerspring structure, said reinforced coil unit having generally equal strength along its length to provide generally equal support to the top and bottom face surfaces of the innerspring structure when placed therein.

14. The method of claim 13 further comprising positioning a plurality of inner coils within respective outer coils and connecting the inner coils to the respective outer coils with said helical lacing wire for producing an area of reinforced coil units in the innerspring structure.

15. The method of claim 13 further comprising placing a border wire around the periphery of the coils at a face surface of the innerspring structure and wrapping a second helical wire around the border wire and around end turns of coils adjacent to the border wire for forming a reinforced periphery at the face surface.

* * * * *

UNITED STATES PATENT AND TRADEMARK OFFICE

CERTIFICATE OF CORRECTION

PATENT NO. : 5,509,642

DATED : April 23, 1996

INVENTOR(S) : Wells

It is certified that error appears in the above-identified patent and that said Letters Patent is hereby corrected as shown below:

In column 5, line 55, please delete the word "wife" and insert the word --wire--.

Signed and Sealed this

Tenth Day of September, 1996

*Attest:*

*Attesting Officer*

BRUCE LEHMAN

*Commissioner of Patents and Trademarks*